US005863696A

United States Patent [19]

Koyama et al.

[11] Patent Number: 5,863,696

[45] **Date of Patent: *Jan. 26, 1999**

[54] TONER PARTICLE FOR ELECTROPHOTOGRAPHY AND PRODUCTION METHOD THEREOF

[75] Inventors: Mikio Koyama; Tomoe Kikuchi; Kenji Hayashi, all of Hino, Japan

[73] Assignee: Konica Corporation, Japan

[ * ] Notice: The term of this patent shall not extend beyond the expiration date of Pat. No. 5,415,964.

[21] Appl. No.: 377,017

[22] Filed: Jan. 20, 1995

[30] Foreign Application Priority Data

Jan. 26, 1994 [JP] Japan ..... 6-007163

[51] Int. Cl.[6] ..... G03G 9/08

[52] U.S. Cl. ..... 430/137; 430/106; 430/109; 430/111

[58] Field of Search ..... 430/106, 111, 430/137, 109

[56] References Cited

U.S. PATENT DOCUMENTS

| | | | |
|---|---|---|---|
| 4,103,074 | 7/1978 | Hertel et al. | 528/487 |
| 4,286,037 | 8/1981 | Hectors et al. | 430/137 |
| 4,983,488 | 1/1991 | Tan et al. | 430/137 |
| 4,996,127 | 2/1991 | Hasegawa et al. | 430/137 |
| 5,118,588 | 6/1992 | Nair et al. | 430/110 |
| 5,137,576 | 8/1992 | MacHoldt et al. | 430/106 |
| 5,415,964 | 5/1995 | Hayashi et al. | 430/106 |

FOREIGN PATENT DOCUMENTS 6-329947 11/1994 Japan .

OTHER PUBLICATIONS

Riddick, T. et al. *Techniques of Chemistry vol. II Organic Solvents* Third Edition, Wiley–Interscience, NY (1970) pp. 61–65, 148–151.

Grant & Hackh's Chemical Dictionary, 5th Edition, (1987) p. 329.

Tapio English Abstract of Japanese Patent 6–329947 (Pub Nov. 29, 1994).

*Primary Examiner*—Janis L. Dote

*Attorney, Agent, or Firm*—Jordan B. Bierman; Bierman, Muserlian and Lucas LLP

[57] ABSTRACT

A non-spherical toner particle for developing an electrophotographic image and its producing method are disclosed. The toner particle is one which is produced by coagulating and fusing a plurality of pigment-including polymer particles which are formed by emulsion polymerization of at least one hydrophobic polymerizable monomer in an aqueous phase in the presence of a surfactant, pigment particles, which has a calcium content of zero to 0.1% by weight, dispersed in said aqueous phase and a water-soluble radical polymerization initiator.

5 Claims, 1 Drawing Sheet

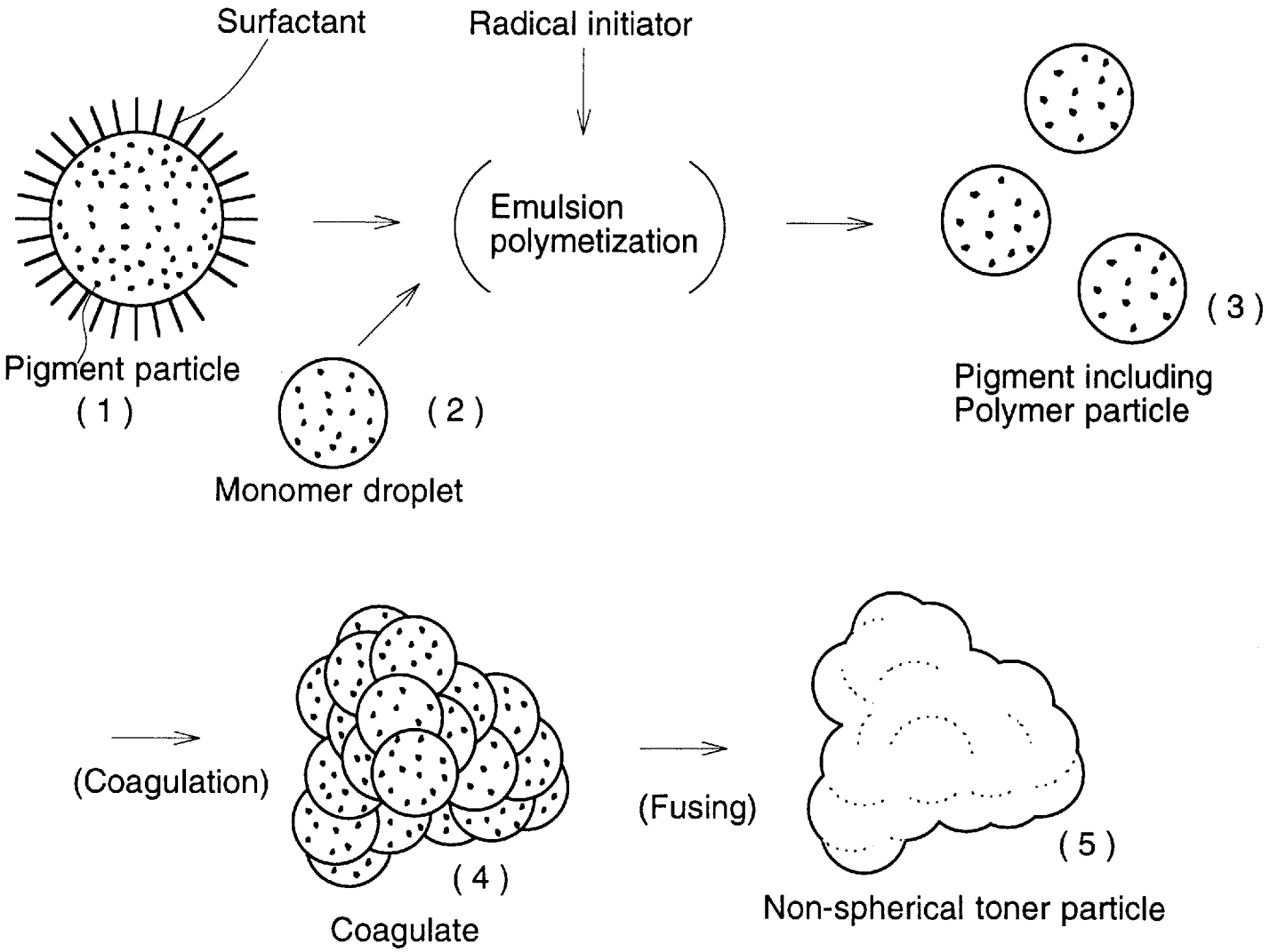
Surfactant
Radical initiator
Emulsion polymetization
Pigment particle
( 1 )
( 2 )
Monomer droplet
( 3 )
Pigment including Polymer particle
(Coagulation)
( 4 )
Coagulate
(Fusing)
( 5 )
Non-spherical toner particle

TONER PARTICLE FOR ELECTROPHOTOGRAPHY AND PRODUCTION METHOD THEREOF

FIELD OF THE INVENTION

This invention relates to an improved pigment-composite polymer particle and the preparation process thereof, a toner for electrophotographic use and a material for immunologically diagnostic use and, particularly, to an improved magenta pigment-composite polymer particle and the preparation process thereof, a toner for magenta and electrophotographic use and a carrier for immunologically diagnosing reagent use.

BACKGROUND OF THE INVENTION

A colored polymer particle constituting a toner for electrophotographic use and a colored polymer particle being applied to a carrier for immunologically diagnosing reagent are required to have a particle-size as small as possible. In the field of toners for electrophotographic use, for example, it is not only to expect to obtain a toner having a small particle-size and a narrow range of particle-size distribution, which has been hardly obtained in any conventional kneading/pulverizing process, in such a manner that colored polymer particles having a small particle-size are plurally associated and are then heatedly fused so that a toner particle may be synthesized, but also expected that a toner having a high pigment dispersibility and, accordingly, a high image transparency may be obtained, and that the toner configuration may further readily be controlled. However, it has not been able to realize the expectations in the conventional kneading/pulverizing process, as described above.

A carrier for immunologically diagnosing reagent use has been demanded to be a colored polymer particle having a small particle-size, from the viewpoints of the sharpness of a cohesion image and the speed of an immune cohesion reaction.

For realizing the demand, a polymer particle itself is required to have a satisfactory dispersion stability and to be stable in a step for compounding a pigment serving as a colorant. As for a toner for electrophotographic use, it is required to induce no unnecessary cohesion in a step for associating particles. As for a carrier for immunologically diagnosing reagent use, it is required to be stable when sensitizing an immunologically active species such as an antigen, an antibody and so forth and also to be so satisfactory in storage stability that the carrier dispersion state is invariable even when storing for a long time.

It is an object of the invention to securely provide a process in which the above-mentioned problems can be solved and a pigment-including polymer particle having a satisfactory dispersion stability can be prepared and, further, a toner for electrophotographic use having a particle-size and a particle-size distribution each controlled by making use of the pigment-composite polymer particle.

In other words and to be more concrete, it is an object of this invention is to provide a stable pigment-including polymer particle.

Another object of the invention is to provide a pigment-including polymer particle containing a finely particle-sized pigment excellent in spectral characteristics, light fastness and color fading resistance.

A further object of the invention is to provide a toner for electrophotographic use excellent in spectral characteristics, light fastness and color fading resistance, and improved in the dispersibility of a pigment.

Still further object of the invention is to provide a carrier for immunologically diagnosing reagent use ready for observing a coagulation image and excellent in stability.

SUMMARY OF THE INVENTION

The non-spherical toner particle for developing an electrophotographic image of the invention is that which is produced by coagulating and fusing a plurality of pigment-including polymer particles which are formed by emulsion polymerization of at least one hydrophobic polymerizable monomer in an aqueous phase in the presence of a surfactant, pigment particles, which has a calcium content of zero to 0.1% by weight, dispersed in the aqueous phase and a water-soluble radical polymerization initiator.

The non-spherical toner particle is prepared by a producing method comprising the steps of dispersing pigment particles, which have a calcium content of zero to 0.1% by weight of the pigment particles, in water in the presence of a surfactant in a concentration within the range of one to ten times of the critical micelle concentration thereof, to form a pigment dispersion, adjusting the concentration of the pigment dispersion so as to made the concentration of the surface active agent in the dispersion to be within the range of 0.8 to 3 times of the critical micelle concentration thereof, emulsifying a polymerizable monomer in said pigment dispersion and adding a water-soluble radical polymerization initiator so that the the concentration of said polymerization initiator in the emulsion "a" in mol per liter and that of said monomer "b" in mol per liter satisfy the following equations:

$$0.001 \leqq a \leqq 0.03,$$

and $$0.001 \leqq a/b \leqq 0.10,$$

polymerizing the monomer to form polymer particles each including the pigment particles, coagulating the polymer particles by adding an electrolyte and an organic solvent which is infinitely soluble in water, and fusing the polymer particles in each coagulation by heating at a temperature within the range of from the temperature lower by 5° C. than the glass transition temperature of the polymer to the temperature higher by 50° C. than the glass transition temperature of the polymer to form non-spherical toner particles.

The non-spherical toner-including polymer particle of the invention is also suitably used for a carrier for fixing physiologically active substance to be used for immunological diagnostic reagent.

BRIEF DESCRIPTION OF THE DRAWING

FIG. 1 is a schematic drawing describing a producing process of non-spherical toner particle of the invention.

DETAILED DESCRIPTION OF THE INVENTION

For achieving the above-mentioned objects of the invention, the present inventors have discovered to make use of a pigment-including polymer particle prepared in the following manner. In the presence of a surfactant having a concentration not lower than a critical micelle formation concentration (or CMC), a pigment is dispersed in an aqueous phase so as to have a particle-size not larger than a specific size and the resulting dispersed matter is then diluted to be not higher than the CMC. A monomer is then added thereto and an aqueous emulsion polymerization is carried out, so that the pigment-including polymer particle could be prepared. The present inventors have also discovered such a method that, when using the particle as a toner for electrophotographic use, any desired particle-size can be obtained, the particle-size distribution range can be narrow and the particle configuration can readily be controlled, in the following manner. An electrolyte having a concentration not lower than a critical coagulation concentration is added to a pigment-including polymer particle dispersion liquid so that the particles are coagulated. Then, an organic solvent infinitely soluble to water is added thereto and the resulting matter is fused with heating at a temperature within the range of not higher than −5° C. of the glass transition temperature of the polymer particle to +50° C. thereof to produce a non-spherical pigment-including particle.

When a pigment-including polymer particle is prepared in the above-described method, it was discovered that some pigment has such a disadvantage that it lacks a dispersion stability and an undesired agglomeration of polymer particles is liable to produce, so that it resultingly lacks the controllability of the particle-size. And, when an immunologically active species is fixed to the surface of the particle, it was also discovered that a dispersion stability is seriously deteriorated similarly when mixing it with various kinds of pH buffers.

The formation process of a non-spherical toner particle of the invention is schematically described in FIG. 1. First, a pigment is dispersed in a water phase in the presence a surfactant (1). A polymerizable monomer is emulsified in the pigment dispersion in a droplet form (2) and a water-soluble radical polymerization initiator is added to initiate polymerization reaction. As the result of the reaction, polymer particles each including pigment particles (3) are formed. Thus obtained pigment-including particles are coagulated by addition of a electrolyte and an organic solvent to form coagulated particles each composed of several pigment-including particles (4). The coagulated pigment-including particles are fused in individual coagulated particle to form a non-spherical toner particle (5).

Generally, there may be some instances where a variety of additives may be added to a pigment available on the market so as to provide a dispersion stability and a coloring property to the pigment. In particular for the above-mentioned purpose, it has been known that a rosin salt has widly been added as an additive to a quinacridone derivative pigment having been used as a magenta pigment. When the above-mentioned pigment is used as a colorant for a paint or a printing ink, the rosin salt improves the dispersibility of the colorant in a binder or a solvent and, resultingly, the rosin salt is added in a proportion within the range of some percent to ten-odd percent of a pigment used for the purpose of improving the coloring property. Particularly, colorless rosin calcium is used for this purpose. When a pigment is synthesized, it has been known that rosin calcium is added in the form of a rosin solution to the subject pigment and that such a treatment is carried out that the rosin is converted into a calcium salt thereof and the calcium salt is made present on the surface of the pigment. Regarding such technique, for example, Shikizai Kogaku Hand Book (Colorant technology Hand Book, Edited by the Association of Coloring Material, Asakura Shoten (1989), can be referred.

When preparing a paint or a printing ink, it is well-known fact in the field of the art that the dispersibility of a rosin salt-treated pigment can be improved in a binder solution or a solvent. However, there is a tendency to seriously deteriorate the dispersibility in an aqueous system and a lot of energy are required for making a pigment to have a desired particle-size when the pigment contains rosin calcium salt.

A rosin calcium salt is hardly soluble to water, but readily soluble under an alkaline condition. When it is dissolved in an aqueous phase, it is natural that free calcium ion is made present in a system. It is presumed that an aqueously emulsion polymerization for including a pigment in a polymer particle takes a polymerization mechanism basically resembling an emulsification polymerization. When the polymer particle is anionic and if a free calcium ion should be produced in the course of a polymerization for some reason, it has been known that a uncontrollable agglomeration of polymer particles is liable to produce because the dispersion stability of the particle is deteriorated in the initial polymerization stage where a polymerization conversion rate is especially low. With a divalent cation such as calcium ion, it has also been known that the dispersion stability inhibition property of a polymer particle is several tens times as much as that of a monovalent electrolyte such as sodium ion or potassium ion, so that a undesired coarse agglomerated particle is liable to uncontrollably produce.

When utilizing it as a toner for electrophotographic use, it is required that plural pigment-including polymer particles are to be coagulated and stuck by fusing. For stabilizing the reaction and narrowing the particle-size distribution of the polymer particles to be produced, it is desired that a part of or the whole ion-dissociative group on the surface of a pigment-including polymer particle is to be in the dissociated state if occasion required. For example, in the case that the above-mentioned dissociative group is of the carboxylic acid, sulfonic acid, phosphoric acid or the like, the dissociated state can be made by adding an alkali. In this course, a rosin salt such as rosin calcium added to a pigment is freed by adding the alkali, so that a coarse agglomerated particle is readily be produced.

As it is the matter of course, when utilizing it as a carrier for immunologically diagnosing reagent use, it is also required that a pigment-including polymer particle is buffered with various kinds of pH buffers when occasion demands. In this case, the freed calcium ion thereby produced resultingly inhibits the dispersion stability of a pigment-including polymer particle dispersion liquid.

For avoiding the above-mentioned disadvantages, it is required to maintain a calcium content of a pigment at 0 to 0.1% by weight. Accordingly, a rosin salt added in to a pigment should be removed. Stability of a pigment-including polymer particle as described. It is, however, needless to say that it is the less the rosin salt is, the better, from the viewpoint of controllability of coagulation.

The method of removing a rosin salt from a pigment can be performed in the following manner. After dispersing the subject pigment in a solvent capable of dissolving the subject rosin salt and the rosin salt is then dissolved well, a filtration and washing treatment is repeated and then a drying treatment is carried out. It is also suitable to make use of a pigment containing no rosin salt available on the market. To be more concrete, in the case that a rosin salt is of rosin calcium, a pigment from which rosin calcium is substantially removed can be prepared by dispersing the pigment in an aqueous alkali solution or heated toluene and a filtration treatment is carried out and, after that, a washing and filtration treatment is repeated and then a drying treatment is carried out as it is in the case of making use of the heated toluene. In the case that a rosin salt is of alkali, a pigment from which rosin calcium is substantially removed can be prepared by carrying out a washing treatment and then by removing the alkali in a washing, dialyzing or ultrafiltrating treatment or the like, if required, and finally by carrying out a drying treatment.

The pigments applicable to the invention include, particularly, a magenta pigment and, further, a quinacridone derivative pigment. The quinacridone derivative pigments include, for example, the following pigments given in Color Index CI.

| | | |
|---|---|---|
| CI Pigment | Violet | 19 |
| CI Pigment | Red | 202 |
| CI Pigment | Red | 206 |
| CI Pigment | Red | 207 |
| CI Pigment | Red | 207 |
| CI Pigment | Red | 209 |
| CI Pigment | Red | 122 |

These pigments is dispersed in an aqueous phase in the presence of a surfactant in a concentration of 1 to 10 times of CMC of the surfactant, in an ordinary process to form a pigment dispersion. The processes of dispersing them shall not be specially limited. However, the processes thereof include, for example, a supersonic dispersion process, a sand stirrer dispersion process and a pressurizing dispersion process. These processes may suitably be selected so as to meet the requirements.

The surfactants may suitably be selected from the group consisting of an anionic surfactant and a cationic surfactant. For example, these surfactants include those made of sodium dodecyl sulfate, sodium dodecylbenzene sulfonate, ammonium dodecyltrimethyl chloride or ammonium hexadecyltrimethyl chloride. Among them, sodium dodecyl sulfate is preferred.

A surfactant applicable to the invention is preferably used in an amount so that the concentration thereof is maintained at a concentration three times as much as that of 0.8 to 3 times of CMC in the course of polymerization process. The surfactant may be added in the whole amount when dispersing a pigment, or it may also be added in a part when making a polymerization, for the purpose of preventing the operability from deterioration caused by bubbles produced when making a dispersion.

When the concentration of a surfactant is low in an aqueous solution, it is ordinary that the surfactant is ion-dispersed or molecule-dispersed. However, when the concentration is increased to reach a certain saturated concentration, several molecules (ions) to a hundred and several tens molecules (ions) are associated rapidly to form a micelle that is stable in an aqueous solution. This saturated concentration is called a critical micelle concentration CMC. In this measurement, aqueous solutions of different surfactants are prepared and surface tensions are measured and CMC can be determined easily through a method wherein the concentration at which the reduction of the surface tension stops represents CMC. In the present invention, a surfactant means a low molecular surfactant including an anionic surfactant, a nonionic surfactant, a cationic surfactant and an ampho-ion surfactant each having the CMC. Under the critical micelle concentration of the surfactant, it is difficult for the pigment to finely disperse into water phase. In addition, in the case of emulsifying polymerization, the reaction speed is extremely reduced under CMC so that polymerization is not completed when the concentration of the surfactant os lower than 0.8 times of CMC thereof. On the other hand, when polymerization is conducted at the concentration of surfactant three times higher than the CMC, phase separation of the pigment and polymer grain each other occurs so that pigment-including polymer grain can not be produced stably.

The surfactants preferably usable in the invention are those having a molecular weight Mw of not more than 2000.

It is preferable that the pigment particles dispersed in such a manner as mentioned above are to have a particle-size not larger than 10 times as large as the primary particle-size thereof. When the dispersed particle-size of the pigment particle becomes larger to have a particle-size not larger than 10 times as large as that of the primary particle-size, a pigment-including polymer particle can hardly be stably produced, because a polymerization relating to the invention can hardly be progressed and an undesired phenomenon is produced such as the production of a coarse agglomerated block. Therefore, the dispersed particle-size of a pigment is to be not larger than preferably 5 times and particularly 3 times as large as the primary particle-sizes in terms of the average particle-size.

The monomers relating to the invention are suitably selected from the group consisting those comprising a hydrophobic monomer and a hydrophilic monomer in a proportion within the range of about 99.9 to 85% by weight for the former and about 0.1 to 15% by weight for the latter, respectively, the weight percents are based on the total weight of the hydrophobic monomer and the hydrophilic monomer.

A hydrophobic monomer called in the present invention represents those whose solubility is 2.5% or less at room temperature and a hydrophilic monomer represents those whose solubility is larger than 2.5% at room temperature.

When preparing a pigment-including polymer particle of the invention, it is prepared through the following preparation steps, namely, a dispersion step in which a pigment is dispersed in an aqueous phase in the presence of a surfactant in a concentration not lower than a critical micelle formation concentration (CMC) of the surfactant; a control step in which a pigment in a pigment dispersed liquid is controlled to have a suitable concentration in the course of carrying out a polymerization and a surfactant is controlled to have a desired concentration in the course of carrying out the polymerization; and a polymerization step in which a monomer and a polymerization initiator are added each in a specific amount to the dispersion liquid of which the concentration was controlled and an aqueous emulsion polymerization is then carried out.

As for the polymerization initiator applicable to the polymerization system, a water-soluble radical initiator may be used. Some of the examples of the water-soluble radical polymerization initiators may be given as a persulfate such as potassium persulfate and ammonium persulfate, a water-soluble azo type compound such as 4,4-azobis-4-cyanovaleric acid and the salts thereof and 2,2'-azobis(2-amidinopropane) salt, and a water-soluble peroxide such as hydrogen peroxide and 1-peroxymaleic acid. They may be used independently or in combination so as to serve as a redox type polymerization initiator. As for the reducing agents, ascorbic acid, sodium bisulfite and Rongalite may be given. With a redox type polymerization initiator, a polymerization time can be shortened, because its polymerization activity is high and a low temperature polymerization can be performed. Generally speaking, it is preferable to make use of a persulfate.

An amount of the above-mentioned polymerization initiator to be added may be selected from the range between 0.001 mols/liter and 0.03 mols/liter and, preferably, between 0.003 mols/liter and 0.025 mols/liter. When the concentration of a polymerization initiator to be added is represented by a (in mol/liter) and an amount of a monomer to be added is represented by b (in mol/liter), it is preferable when a value of "a/b" is to be within the range of 0.004 to 0.10. When the adding concentration of a polymerization initiator is too small, a polymerization can hardly be completed, because the amount of radical produced is diminished. When it is too large, a polymerization reaction can hardly be controlled and the production ratio of a low molecular weight oligomer becomes higher. It is, therefore, not preferable, because a phase separation may sometimes be produced between a pigment and a polymer.

The molecular weight and molecular weight distribution of the above-mentioned polymer may be used within various ranges so as to meet the purposes of the application. When using it as a toner for electrophotographic use, a weight average molecular weight (hereinafter abbreviated to as Mw) applicable thereto is within the range of 5,000 to 500,000 and, preferably, 10,000 to 300,000. As for the guiding index of a molecular weight distribution, a ratio of a weight average molecular weight/a number average molecular weight (hereinafter abbreviated to as Mw/Mn) is generally within the range of 1.5 to 20 and, preferably, 1.8 to 15.

The controls of a molecular weight and a molecular weight distribution can freely be achieved by adding an amount of a polymerization initiator and by adding a chain-transfer agent to a polymerization reaction system. The chain-transfer agents applicable thereto include, commonly, a thiol compound such as dodecane thiol. A suitable selection thereof can be made by a chain-transfer constant to a monomer applied thereto.

The concrete examples of the hydrophobic monomers applicable to the invention include a styrene derivative such as styrene, p-methyl styrene, o-methyl styrene, p-methoxy styrene, o-methoxy styrene, p-ethoxy styrene, o-ethoxy styrene, p-butoxy styrene, o-butoxy styrene, p-chloro styrene, o-chloro styrene, m-chloro styrene, 2,4-dichloro styrene, 2,4-dimethyl styrene, p-chloromethyl styrene, m-chloromethyl styrene, o-chloromethyl styrene, o-hydroxy styrene, p-hydroxy styrene and o-hydroxy styrene.

They further include, for example; an acrylic acid ester and methacrylic acid ester such as methyl acrylate, methyl methacrylate, ethyl acrylate, n-butyl acrylate, n-butyl methacrylate, sec-butyl acrylate, sec-butyl methacrylate, tert-butyl acrylate, tert-butyl methacrylate, 2-ethylhexyl acrylate, 2-ethylhexyl methacrylate, cyclohexyl acrylate, cyclohexyl methacrylate, glycidyl acrylate glycidyl methacrylate, n-dodecyl acrylate and n-dodecyl methacrylate; a nitrile type monomer such as acrylonitrile and methacrylonitrile; a vinylether type monomer such as vinyl methyl ether and vinyl ethyl ether; a diene such as butadiene, isoprene, chloroprene and dimethyl butadiene; a halogenated vinyl monomer such as vinyl chloride, vinylidene chloride, vinyl fluoride, vinylidene fluoride and trifluoroethylene; a vinyl ester such as vinyl acetate; and an olefin monomer such as ethylene and propylene. Further, a cross-linking monomer include, for example, divinyl benzene, ethylene glycol dimethacrylate and trimethylolpropane triacrylate.

A polymer of the invention is preferable to contain a hydrophilic monomer containing an ion-dissociative group. These monomers include, for example, those containing a carboxyl group, a sulfonic acid group, a phosphoric acid group, a primary amino group, a secondary amino group, a tertiary amino group or a quaternary ammonium salt group. These monomers are preferable to contain these groups in a proportion within the range of 0.1 to 15% by weight of a monomer.

The examples of the above-given monomers include a vinyl monomer containing such a carboxyl group as those of acrylic acid, methacrylic acid, itaconic acid and maleic acid; a vinyl monomer containing such a sulfonic acid group as those of styrene sulfonic acid or acrylamidopropane sulfonic acid; a vinyl monomer containing such an amino group as those of aminostyrene, aminoalkyl acrylate, aminoalkyl methacrylate, monoalkylaminoalkyl acrylate monoalkylamino methacrylate, dialkylaminoalkyl acrylate, and dialkylamino methacrylate; and such a quaternary ammonium salt as vinyl benzyl trialkyl ammonium salt. A vinyl monomer containing an amino group or an ammonium salt group may also be prepared by polymerizing in advance a vinyl monomer having an active halogen group that is a precursor including a vinyl monomer having a chloromethyl group such as vinyl benzyl chloride and then by reacting an amino compound with the resulting polymerized monomer.

When using it as a toner for electrophotographic use, it is required that the pigment-including polymer particles of the invention are plurally coagulated and the resulting coagulated particles are stuck each other by heatedly fusing at a temperature within the range of −10° C. to +50° C. in terms of Tg of the polymer. The above-mentioned process include, for example, such a process as disclosed, for example, in JP OPI Publication No. 60-220358/1985, in which a mixture dispersion of polymer particles produced by an emulsification polymerization and a and dispersed particles of a pigment (i.e., a colorant) are subjected to a salting-out treatment, so that a toner can be prepared. This process is, however, so-called a rapid coagulation process, of which has been known that a particle-size can hardly be controlled and a particle-size distribution is liable to be seriously widened. Therefore, such a step is inevitably carried out in which a particle-size distribution is narrowed in some way after a coagulated particle is produced. Therefore, this process has such a disadvantage that the operability is seriously inefficient.

On the other hand, the process of the invention is excellent, because the controllabilities of a particle-size and a particle-size distribution are excellent and, after completing a particle, the resulting particle can satisfactorily be utilized as a toner for electrophotographic use, by carrying out a filtration, washing and drying steps only. Further, in the process of the invention, a plurality of pigment-including polymer particles of the invention are associated together and a fusing treatment is carried out between the primary particles of the coagulated particles by applying heat to the associated particles in the neighborhood of Tg of the polymers, so that a toner for electrophotographic use can be prepared. The process is detailed in JP Publication open to Public Inspection No. 6-329947/1994.

By reducing distribution stability of pigment-including polymer particle dispersion of the present invention, the pigment-including polymer particle produces a coagulates particles wherein several particles are associated. At that time, a part of or all dissociated group on the surface of the polymer grains is caused to be ionically dissociation state so that production of coarse aggromerated block are inhibited. In addition, when a solvent which is dissolved in water infinitely is added, rapid coagulation of pigment-including polymer particles are inhibited so that the control of coagulated particle size distribution becomes possible. In addition, by heating the pigment-including polymer particle at the glass transition point or higher, pigment-including polymer particles inside the coagulated particles occur heat melting so that non-spherical grains wherein mechanical strength is high and the particle size and the particle size distribution are controlled can be obtained.

The above-mentioned process is comprised of the following steps to be applied to a pigment-including polymer particle dispersion liquid, namely, (1) a step of adding a water-soluble metal salt or the aqueous solution thereof, (2) a step of adding an organic solvent capable of infinitely soluble to water, and (3) a step of sticking by heatedly fusing the particles in coagulate at a temperature within the range of −5° C. to +50° C of Tg of the subject polymer.

As for a metal salt applicable to a water-soluble metal salt or to the aqueous solution thereof, sodium chloride, potassium chloride, lithium chloride and so forth as a monovalent metal salt, calcium chloride, zinc chloride and so forth as a divalent metal salt, and aluminum chloride and so forth as a trivalent metal salt can be used for, provided, however, that the invention shall not be limited thereto. The above-mentioned metal salt is added to a pigment-including polymer particle dispersion liquid, in a concentration of not less than a critical coagulation concentration that is the lowest concentration to start to make the pigment-composite polymer particle coagulated. The critical coagulation concentration can readily be determined by the skilled in the art. For example, there is a method in which a subject metal salt is added in various concentration to a subject pigment-including polymer particle dispersion liquid so that the lowest concentration for producing a coagulated particle can be obtained.

There is also another method in which a subject metal salt is added in various concentration to a subject pigment-including polymer particle dispersion liquid and the resulting ζ-potential is measured, so that a critical coagulation concentration can be determined to be the salt concentration at which the ζ-potential is started to be lowered.

A further improvement of the controllabilities of a particle-size and a particle-size distribution of coagulated particle can be achieved in such a manner that a part of or the whole ionic dissociation group of a pigment-composite polymer particle is set in the dissociated state and the same operations as mentioned above is then carried out.

An organic solvent capable of infinitely dissolving to water is added to the pigment-including polymer particle dispersion liquid having been mixed with the metal salt and set in the coagulated state. By adding the above-mentioned organic solvent thereto, stable coagulated particles each having a narrow particle-size distribution can be produced, though the functional mechanism has not been cleared. The organic solvents infinitely soluble to water applicable thereto include, for example, methanol, ethanol, n-propyl alcohol, iso-propyl alcohol, dioxane and acetonitrile. Among them, iso-propyl alcohol is preferably used. An organic solvent infinitely soluble to water relating to the invention may be added selectively in a proportion within the range of 5% by volume to 300% by volume of a subject pigment-including polymer particle dispersion liquid. The resulting mixed liquid is heated with stirring for a specific period of time in the above-mentioned state, under the temperature conditions within the range of −5° C. to +50° C. of the glass-transition temperature (Tg) of the polymer of the pigment-including polymer particle, so that a toner particle can be synthesized.

In the above-described method, an average particle-size, a particle-size distribution and a particle configuration can be varied by varying a metal salt and the amount added, heating temperature, heating time and so forth of an organic solvent infinitely soluble to water.

A heating temperature is suitably selected from the range of −5° C to +50° C. and, preferably, −5° C. to +40° C. of the Tg of a polymer used. When increasing an amount of a metal salt added, an average particle-size generally tends to be larger. When increasing an amount of an organic solvent added, an average particle-size also tends to be larger. Further, a particle configuration tends to become akin to a perfect sphere. When raising a heating temperature, a particle-size growth rate is increased and at the same time a particle configuration tends to become akin to a perfect sphere. And, when raising a heating temperature, it tends to progress a fusion between particles and to increase a mechanical strength. When suitably selecting these conditions, a particle having any desired average particle-size, particle-size distribution and particle configuration can be obtained.

When making use of the above-mentioned particle as a toner for electrophotographic use, the particle configuration will become problematic. In particular, it is said that a perfect spherical particle has a problem of cleaning property. A particle configuration can be expressed in terms of non-sphering degrees. A non-sphering degree can be defined by the following formula;

Non-spheral degree=(BET specific surface area of a particle)/(A surface area obtained by converting an average particle-size of a particle into a perfect sphere)

When a non-spheral degree is 1, it represents a perfect sphere. When the degree is higher, a subject particle configuration is akin to be more non-spherical. When a particle has a non-spheral degree within the range of 1.1 to 10, it can be used as a toner for electrophotographic use. When a particle is too low in sphering degree or has a perfect spherical configuration, it can hardly be used, because the aptitude is so limited as to carry out a cleaning step in an electrophotographic process. On the other hand, when a non-sphering degree becomes higher, it is apprehended that a particle may be pulverized by stirring it in a developing unit, that fine powder may also be produced therein and that an image quality may further be deteriorated in a selective development.

It is allowed, if required, that a non-spherical particle of the invention can be incorporated with a fixing property improving agent, a static controlling agent and so forth. These additives can be synthesized in such a manner that an aqueous dispersion liquid is so prepared by dispersing the additives in the form of fine particles in advance in an aqueous phase, and, if required, the resulting dispersion liquid is mixed with a pigment-including polymer particle dispersion liquid of the invention when making a non-sphering reaction, so that they can be synthesized in the process of the invention described in JP O.P.I. No. 6-329947/1994.

As for the fixing property improving agents, any well-known ones can be used. Generally, the following polyolefin type wax have been used for. Namely, for example, a low molecular weight polyethylene, a low molecular weight polypropylene, an oxidation treated polyethylene, polypropylene.

In an ordinary process, these fixing property improving agents are fused and are then dispersed in water in the presence of a dispersant and, if required, they are used in the form of an alkali-modified emulsion. As for the fixing property improvers, a polyethylene or polypropylene wax emulsion available on the market under the trade name of "HITEC" (of Toho Chemical Industrial Co.) can also be used.

The processes for introducing a fixing property improving agent into a non-spherical particle include, for example, the following processes;

(1) a process in which a fixing property improving agent and a pigment are dispersed in an aqueous phase at the same time and a polymerization is the carried out. Thereby, a pigment-including particle is prepared and is then converted into a non-spherical particle by making a non-sphering treatment;

(2) Another process in which a polymer particle containing a pigment is added to a solution prepared by dissolving a fixing property improving agent in an organic solvent so as to swell and absorb the solution in the particle, in the same manner as a seed polymerization, so that the resulting particle is used in a coagulation treatment; and (3) a further process in which a polymer particle containing a pigment is simultaneously coagulated with a wax emulsion, when preparing a non-spherical particle in a coagulation treatment.

The above-mentioned processes are preferable for a process of incorporating a fixing property improving agent into a non-spherical particle. Among these processes, processes (1) and (3) are more preferable, because these two processes are ready to use and are capable of introducing a necessary amount of a fixing property improver into a non-spherical particle. Such a fixing property improving agent can be contained in a proportion within the range of about 0.1 to 20% by weight and, preferably, about 0.5 to 15% by weight of a binder polymer.

The static controllability of a non-spherical particle of the invention can be given by an ion-dissociation group made present on the surface of a pigment-composite polymer particle. However, if required, it is also allowed to achieve the object in such a manner that a static controlling agent is contained in a pigment-composite polymer particle or a non-spherical particle.

A static controlling agent include, for example, those of the positively static type such as a nigrosine type electron-donative dye, a metal salt of naphthenic acid or higher aliphatic acid, alkoxylated amine, quaternary ammonium salt, alkylamide, a metal complex, a pigment and a fluorinated surfactant; and those of the negatively static type such as an electron-acceptive metal complex, chlorinated paraffin, chlorinated polyester and sulfonylamine of copper phthalocyanine. Further, chrome yellow, aniline blue, an azo type metal-containing dye and so forth may also be included therein. These static controllers may be incorporated into a non-spherical particle in the same way as the case of the foregoing fixing property improving agents.

A non-spherical particle of the invention can be independently used as a toner for electrophotographic use as they are. However, for improving the property as a toner, various additives may be added thereto. For example, a fluidizer may be given as one of the examples thereof. The fluidizing agents include, for example, silica, titanium oxide, aluminum oxide and a fine powder of the hydrophobicly treated matter thereof and an organic macromolecular fine particle comprising a hydrophobic monomer unit derived from a macromolecular latex. A fluidizing agent may be added in a proportion within the range of, preferably, 0.01 to 20 parts by weight to 100 parts by weight of a toner used and, particularly, 0.1 to 10 parts by weight thereof.

As for the other additives, a lubricant may also be given as one of the concrete examples. The lubricants include, for example, the metal salts of a higher aliphatic acid such as a cadmium, barium, nickel, cobalt, strontium, copper, magnesium or calcium salt of stearic acid; a zinc, manganese, iron, cobalt, copper, lead or magnesium salt of oleic acid; a zinc, manganese, cobalt, copper, magnesium, silicon or calcium salt of palmitic acid; a zinc, cobalt or calcium salt of linolic acid; a zinc or cadmium salt of ricinolic acid; a lead salt of caprylic acid; and a lead salt of caproic acid. The above-given additives may also suitably be added.

(Carrier for fixing a physically active substance use)

A quinacridone derivative pigment-increasing polymer particle of the invention can be used as a carrier of a physically active substance and can also be useful as an immunodiagnosing reagent. A physically active substance include, for example, oxygen, an antigen, an antibody, a receptor, deoxyribonucleic acid and ribonucleic acid. However, in the case of deoxyribonucleic acid or ribonucleic acid, when a single-chained deoxyribonucleic acid or a single-chained ribonucleic acid is fixed, the other single-chained deoxyribonucleic acid or a single-chained ribonucleic acid coupling mutually compensable thereto can be detected. The physically active substance may be used, if required, by fixing it to the surface of a quinacridone derivative pigment-including polymer particle of the invention in any well-known method. In particular, a quinacridone derivative pigment-composite polymer particle of the invention is colored in magenta and has such an advantage that a more clearer cohered image can be observed even when the reagent is diluted, as compared to the white colored conventional latex type reagent or some of dye-tinted latex type reagent.

A process of fixing a physically active substance include, for example, a physical adsorption process and a chemical coupling process. In the case of the physical adsorption process, a quinacridone derivative pigment-composite polymer particle of the invention can be provided with a stable adsorption property by arranging a hydrophobic surface to the particle and, particularly, by arranging a styrene unit to the surface thereof. In the case of the chemical coupling process, the fixation of a physically active substance can be achieved by making use of a functional group contained in the physically active substance, such as a carboxyl group, an amino group and an SH group and then by introducing a functional group capable of reacting with any well-known two-functional reagent such as an amino group, a carboxyl group, an SH group and an epoxy group.

On the other hand, these functional groups can also be used similarly in a non-spherical particle of the invention. Particularly, a non-spherical particle can freely vary the surface area thereof and it can have a relatively wider surface area as compared to that of a perfect sphere. Therefore, a non-spherical particle has the advantages that the amount of a physically active substance fixed up can be increased and that the reaction rate can be accelerated.

When making use of a quinacridone derivative pigment-composite polymer particle of the invention, the average particle-size thereof is to be within the range of 0.1 $\mu$m to 1.5 $\mu$m. When making use of a non-spherical particle of the invention, the average particle-size thereof is preferable to be within the range of double to ten times as large as the primary particle-size, that is, within the range of 0.35 $\mu$m to 3 $\mu$m.

EXAMPLES

(Example 1)

(Removal of a rosin salt)

In an aqueous 5N sodium hydroxide solution, 100 g of a magenta pigment containing a rosin salt (i.e., dimethyl quinacridone: C.I. Pigment Red 122, Trade Name: KET RED 309, available from Dai-Nippon Ink Chemical Industries Co.) was dispersed and stirred well in a 5N sodium hydroxide solution, and then the pigment was filtrated through a reduced pressure filtration. The same procedures were further repeated twice. Finally, the pigment was dispersed in pure water and washed. The reduced pressure filtration and washing were repeated until the pH was neutralized after completing the filtration. After that, the pigment was dried with a reduced pressure and, further, it was confirmed that no calcium could not be detected by making use of an X-ray fluorescence analyzer. Thus obtained sample was referred as M-1.

Similarly, heated toluene was used as a washing medium and the washing treatment was repeated several times. It was then confirmed in the same way as mentioned above that no calcium could not be detected from the resulting reduced pressure filtrated liquid by making use of an X-ray fluorescence analyzer. Thus obtained sample was referred as M-2.

Further, the pigment was changed from KET RED 309 to Fuji Fast Red 9900RM (i.e., dimethyl quinacridone available from Fuji Dye Co., Ltd.), and it was processed with 5N-sodium hydroxide or heated toluene. It was also confirmed that no calcium was made present. The samples treated with sodium hydroxide and that treated with toluene were each referred as M-3 and M-4, respectively.

Besides the above, KET RED 316 (i.e., dimethyl quinacridone: C.I. Pigment Red 122, available from Dai-Nippon Ink Chemical Industries Co.) and PINK EO2 Toner Grade (i.e., dimethyl quinacridone: C.I. Pigment Red 122, available from Hoechst AG.) as a pigment not containing any rosin salt, that is available on the market. These pigments were referred as M-5 and M-6, respectively. KET RED 309 and Fuji Fast Red 9900RM are hereinafter referred to as M-7 and M-8 as they are available on the market, respectively, as the pigments containing a comparative rosin salt. The calcium content of KTT309 (M-7) and Fuji Fast Red 9900RM (M-8) are each 0.79% and 1.32%, respectively.

(Dispersion of Pigment)

In 250 ml of distilled water, 3.6335 g of sodium dodecyl sulfate was dissolved. Further, 26.67 g of pigment of the invention M-1. While the pigment dispersion liquid was stirred by a homogenizer Model US-150T (manufactured by Nihon Seiki Mfg. Works) and a dispersion treatment was carried out for one hour at an output of 300 $\mu$A. Further seven kinds of dispersions were prepared in the same manner as above except that the pigment M-1 was replaced by M-2 to M-8, respectively. After that, from the resulting dispersion liquid, the particle-size and particle-size distribution were measured by making use of a laser diffraction type particle-size measurement instrument SALD-1100 (manufactured by Shimazu Mfg. Works, Ltd.) The results thereof will be shown in Table 1.

TABLE 1

| | Particle-size distribution | | |
|---|---|---|---|
| Pigment No. | Average particle-size (volumetric standard: $\mu$m) | Standard deviation ($\mu$m) | CV |
| M-1 | 0.28 | 0.16 | 0.57 |
| M-2 | 0.32 | 0.18 | 0.56 |
| M-3 | 0.44 | 0.23 | 0.52 |
| M-4 | 0.39 | 0.21 | 0.54 |
| M-5 | 0.26 | 0.15 | 0.58 |
| M-6 | 0.23 | 0.11 | 0.48 |
| M-7 | 2.36 | 2.67 | 1.13 |
| M-8 | 1.89 | 2.47 | 1.31 |

In the above table, the volumetric standard average particle size is a 50% accumulation value, or 50% particle diameter, $d_{50}$ of volumetric diameters of the dispersed particles. The volumetric diameter of the particles are measured by a laser-diffraction method using a laser-diffraction type particle size measuring apparatus. SALD-1100 prepared by Shimazu Mfg. Works Ltd. CV is a coefficient of variation of particle diameter distribution which is a value calculated by dividing a standard deviation of the particle diameter by the above average volumetric diameter thereof. Regarding the determination of the average diameter, "Hand Book of Fine Particle" M. Jinbo et al. Asakura Shoten, (1991) can be referred.

From the results shown in the table, it can be found that the pigments from which a rosin salt was removed are excellent in dispersibility in an aqueous phase, as compared to those containing a rosin salt.

Further, M-7 and M-8 were each dispersed for one hour at a pressure of 600Bar, by making use of a pressure type disperser, MINI-LAB Type 8, 30H (manufactured by RANNIE Co.). The resulting dispersion liquids were named M-7' and M-8', respectively. The results were as follows. M-7' had an average particle-size of 0.28 $\mu$m, a standard deviation of 0.24 $\mu$m and CV=0.86; and M-8' had an average particle-size of 0.26 $\mu$m, a standard deviation of 0.22 $\mu$m and CV=0.85.

As shown above, it is obvious that the dispersion of a pigment containing rosin calcium requires much more energy than a pigment not containing any rosin calcium.

(Synthesization of pigment-including polymer particle)

To a separable flask having a 500 ml-capacity attached with a stirrer, a temperature-sensor, a reflux condenser and a nitrogen-introducer unit, 235 ml of degassed ion-exchange distilled water, 1.2 g of sodium dodecyl sulfate and 15 ml of dispersion liquid was added. Further, 25.33 g of styrene, 75 g of n-butyl acrylate, 1.58 g of methacrylic acid and 0.2 g of 1-dodecyl mercaptan were added thereto. The internal temperature of the resulting mixture was raised to be 70° C. while stirring at the stirring speed of 500 rpm under the nitrogen gas current. At the point of time when the internal temperature raised up to 70° C., a polymerization initiator solution prepared by dissolving 0.760 g of potassium persulfate in 50 ml of degassed ion-exchange distilled water was added. The resulting mixture was polymerized for 7 hours and then cooled down to room temperature. Further 9 kinds of polymer particles each containing pigments M-2 to M-8, M-7' or M-8' were prepared in the same manner as the above except that the pigment was replaced. Thus obtained dispersion liquids of polymer particles were named as P-1 through P-10, respectively. Each of the resulting polymer particle was measured through a particle-size distribution measurement instrument ELS-800 (manufactured by Ohtsuka Electron Co., Ltd.) so as to obtain the average particle-size and particle-size distribution thereof and, further, the molecular weight and molecular weight distribution thereof were also measured after the particle was dried up. The resulting agglomerated matter was filtrated, and the agglomerated matter production ratio was obtained from the amount of monomer incorporated into the particle. The results thereof will be shown in Table 2. The agglomerated matter includes coarse aggromerates not finely dispersed, and matter adhered on the wall of vessel or on the stirrer, which is formed during the polymerization process.

TABLE 2

| Polymer dispersion No. | Pigment No. | Average particle-size (μm) | CV | Molecular weight (Mw) | Molecular weight distribution (Mw/Mn) | Agglomerated matter production ratio (%) |
|---|---|---|---|---|---|---|
| P-1 | M-1 | 0.29 | 0.51 | $2.7 \times 10^4$ | 2.51 | 1.1 |
| P-2 | M-2 | 0.34 | 0.50 | 2.8 | 2.44 | 0.8 |
| P-3 | M-3 | 0.45 | 0.48 | 2.6 | 2.63 | 1.3 |
| P-4 | M-4 | 0.41 | 0.49 | 2.6 | 2.48 | 0.9 |
| P-5 | M-5 | 0.27 | 0.56 | 2.7 | 2.64 | 0.7 |
| P-6 | M-6 | 0.24 | 0.55 | 2.7 | 2.32 | 0.5 |
| P-7 | M-7 | 1.58 | 1.67 | 3.8 | 2.87 | 54.5 |
| P-8 | M-8 | 2.10 | 1.88 | 2.9 | 2.75 | 67.9 |
| P-9 | M-7' | 0.32 | 0.68 | 3.3 | 2.53 | 6.7 |
| P-10 | M-8' | 0.26 | 0.71 | 3.6 | 2.47 | 9.1 |

As is obvious from the results shown above, the polymerization with the use of the pigment of the invention substantially removing a rosin salt therefrom displays a stable dispersibility. Among the comparative pigments containing a rosin salt, on the other hand, those treated in the same dispersion conditions as in the pigments of the invention cannot practically suitable at all, because a lot of coarse agglomerated matters are produced. The pigments made to have a small particle-size by varying the dispersion conditions are also obviously great in cohered matter production ratio and are lacking in polymerization stability, as compared to those of the invention.

(Formation of Non-spherical particle)

Non-spherical particles were synthesized by making use of the foregoing pigment-including polymer particle dispersion liquids of the invention P-1 through M-6 and the foregoing pigment-composite polymer particle dispersion liquids of the comparison P-9 and P-10, respectively. For producing a carboxylic acid ion by dissociation of carboxyl group on the surface of the particle contained in each dispersion liquid, the pH was adjusted to be 7 by making use of an aqueous 5N sodium hydroxide solution. After adjusting the pH, the resulting particle-size and particle-size distribution were each measured by making use of a particle-size distribution measuring instrument ELS-800 (manufactured by Ohtsuka Electron Co., Ltd.). The results thereof will be shown in Table 3 given below.

TABLE 3

| | Before adjusting pH | | After adjusting pH | |
|---|---|---|---|---|
| Polymer dispersion No. | Average particle-size (μm) | CV | Average particle-size (μm) | CV |
| P-1 | 0.29 | 0.51 | 0.29 | 0.51 |
| P-2 | 0.34 | 0.50 | 0.34 | 0.50 |
| P-3 | 0.45 | 0.48 | 0.45 | 0.48 |
| P-4 | 0.41 | 0.49 | 0.41 | 0.49 |
| P-5 | 0.27 | 0.56 | 0.27 | 0.56 |
| P-6 | 0.24 | 0.55 | 0.24 | 0.55 |
| P-9 | 0.32 | 0.68 | 5.73 | 2.37 |
| P-10 | 0.26 | 0.71 | 6.10 | 2.58 |

Concerning P-8 and P-10, the measurements thereof were carried out through a Laser diffraction type particle-size measuring instrument SALD-1100 (manufactured by Shimazu Mfg. Works, Ltd.), because, after the pH was adjusted, the resulting particle-sizes thereof were beyond the measurable scope of a particle-size distribution measuring instrument ELS-800 (manufactured by Ohtsuka Electron Co., Ltd.). It was the matter of course that the pigment-including polymer particle dispersion liquids of the invention have not has any variation of the particle-sizes before and after adjusting the pH thereof; that is indicated that they have a good enough dispersion stability. With the pigment-including polymer particle dispersion liquids of the comparison, on the other hand, a peak of the coagulated matters was newly observed in the neighborhood of about 20 μm and, resultingly, the average particle-size thereof was made larger, in spite of that carboxylic acid ion is produced intrinsically by adjusting the pH thereof so that a dispersion stability can further be provided thereto.

When the critical coagulation concentration was measured by making use of an ELS-800 and potassium chloride as an electrolyte, pigment-including polymer particle dispersion liquids of the invention P-1 through P-6 were each proved to be 0.067 mols/liter, and pigment-composite polymer particle dispersion liquids for comparison P-9 and P-10 were each proved to be 0 mols/liter. Therefore, P-1 through P-6, P-9 and P-10 were each so set as to have the final electrolyte concentration of 0.6 mols/liter. Besides, pigment-including polymer particle dispersion liquids for comparison P-9 and P-10 were also reacted as they remained unadded by any electrolyte. Among the non-spherical particles, those of the invention and those of the comparison were named NS-001 through 006 and 001 through 004, respectively. The non-sphering reaction will be detailed below.

To a four-head separable flask attached with a 500-ml capacity stirrer, a cooling pipe and a temperature sensor, 150 ml of the above-mentioned pH-adjusted pigment-composite polymer particle dispersion liquid was put in and was then stirred at 250 rpm at room temperature. An aqueous potassium chloride solution prepared by dissolving 11.86 g of potassium chloride in distilled water was added thereto and 35 ml of isopropanol was then added thereto.

The resulting mixed solution was heated up to be 85° C. and was then reacted for 6 hours, and was cooled down to room temperature. The glass transition point of the polymer was 62° C. By making use of the resulting reaction solution, the particle-size and particle-size distribution were measured through a laser diffraction type particle-size distribution measuring instrument SALD-1100 (manufactured by Shimazu Mfg. Works, Ltd.). Further, the non-spherical particle was filtrated and was then suspension-dispersed in distilled water. The pH thereof was adjusted to be 13 by making use of an aqueous 1N sodium hydroxide solution and carboxylic acid was made to be in the completely dissociated state. After a washing treatment was repeated so as to remove such an admixture as an electrolyte, the resulting powder was taken out by carrying out a drying treatment.

The BET specific surface area of the resulting powder was measured and, from the average particle-size obtained through a laser diffraction type particle-size distribution measuring instrument SALD-1100, the non-spherical degree of the powder was calculated out. The results thereof will be shown in Table 4 given below.

TABLE 4

| Non-spherical particle No. | Particle-size distribution: Average particle-size (μm) | CV | Non-spherical degree |
|---|---|---|---|
| Non-spherical particle of the invention, | | | |
| NS-001 | 5.53 | 0.51 | 1.52 |
| NS-002 | 5.41 | 0.50 | 1.49 |
| NS-003 | 5.37 | 0.52 | 1.61 |
| NS-004 | 5.33 | 0.49 | 1.45 |
| NS-005 | 5.68 | 0.50 | 1.48 |
| NS-006 | 5.73 | 0.51 | 1.55 |
| Non-spherical particle for comparison, | | | |
| 001 | 32.89 | 0.38 | 1.78 |
| 002 | 38.52 | 0.41 | 1.59 |
| 003 | 18.12 | 0.89 | 1.63 |
| 004 | 19.21 | 1.12 | 1.58 |

As is obvious from the contents of Table 4, the non-spherical particles of the invention can be made fine in size and can also be provided with a substantially narrow particle-size distribution. On the other hand, the comparative non-spherical particles were proved that the particle-size thereof is substantially larger, that there is a limitation to make them finely particulate, that the particle-size distribution is widened when they are used with a finely particulate size, and, therefore, that the particle-size and particle-size distribution thereof can hardly be controlled.

(Example 2)

By making use of magenta pigment dispersion liquid of the invention M-6, a polymerization was carried out by varying the amounts of a surfactant and a polymerization initiator. In the polymerization, 235 ml of degassed ion-exchange distilled water and 15 ml of dispersion liquid M-6 were put in a 500 ml-capacity separable flask attached with a stirrer, a temperature sensor, a reflux condenser and a nitrogen-introducer. Sodium dodecyl sulfate (SDS) was further in an amount of added thereto by 0.483 g. Further, 25.33 g of styrene, 4.75 g of n-butyl acrylate, 1.58 g of methacrylic acid and 0.2 g of t-dodecylmercaptan were added. The internal temperature of the resulting mixture was raised to be 70° C., while stirring at the stirring speed of 500 rpm under the nitrogen gas current. At the point of time when the internal temperature raised up to 70° C., a polymerization initiator solution prepared by dissolving 0.76 g of potassium persulfate (KPS) in 50 ml of degassed ion-exchange distilled water was added. The resulting mixture was polymerized for 7 hours and then cooled down to room temperature. Thus obtained dispersion of polymer particle was named as P-11. The resulting polymer particles was measured through a particle-size distribution measurement instrument ELS-800 (manufactured by Ohtsuka Electron Co., Ltd.) so as to obtain the average particle-size and particle-size distribution thereof. Further, the molecular weight and molecular weight distribution thereof were also measured after the particle was dried up. The resulting cohered matter was taken out after filtrated, and the agglomerated matter production ratio was obtained from the amount of monomer incorporated into the particle. Further, polymer particle dispersions P-12 to P-20 were prepared and evaluated in the same manner as in P-11 except that amounts of sodium dodecyl sulfate and potassium per sulfate were changed as given in Table 5. The polymerization conditions and the results thereof will be shown in Table 5.

TABLE 5

| Polymerization No. | SCS: Amount added (g) | SCS: Concentration added (mol/liter) | KPS: Amount added (g) | KPS: Concentration added (mol/liter) | Average particle-size (μm) | CV | Mw ($\times 10^4$) | Mw/Mn | Agglomerated matter production ratio (%) | a/b |
|---|---|---|---|---|---|---|---|---|---|---|
| P-11 | 0.483 | $8.1 \times 10^3$ | 0.76 | $9.37 \times 10^3$ | 0.25 | 0.54 | 2.73 | 2.51 | 0.2 | 0.0094 |
| P-12 | 1.183 | $1.6 \times 10^2$ | 0.76 | $9.37 \times 10^3$ | 0.25 | 0.55 | 2.72 | 2.48 | 0.2 | 0.0094 |
| P-13 | 1.884 | $2.4 \times 10^2$ | 0.76 | $9.37 \times 10^3$ | 0.25 | 0.56 | 2.76 | 2.56 | 0.2 | 0.0094 |
| P-14 | 1.183 | $1.6 \times 10^2$ | 1.52 | 0.0187 | 0.26 | 0.55 | 2.19 | 2.53 | 0.1 | 0.0188 |
| P-15 | 1.183 | $1.6 \times 10^2$ | 0.38 | $4.69 \times 10^3$ | 0.25 | 0.54 | 6.34 | 2.43 | 0.3 | 0.0047 |
| P-16 | 1.183 | $1.6 \times 10^2$ | 2.40 | 0.0296 | 0.25 | 0.55 | 1.12 | 2.89 | 0.1 | 0.0297 |
| P-17 | 1.183 | $1.6 \times 10^2$ | 8.11 | 0.100 | — | — | 0.94 | 3.62 | — | 0.1004 |
| P-19 | 0 | $2.51 \times 10^3$ | 0.76 | $9.37 \times 10^3$ | 0.32 | 1.37 | 2.79 | 2.51 | 40.3 | 0.0094 |
| P-20 | 1.900 | 0.0245 | 0.76 | $9.37 \times 10^3$ | — | — | — | — | — | 0.0094 |

As is obvious from the contents of Table 5, P-11 through P-16, which were within the scope of the initiator concentration, surfactant concentration and the ratio of (the initiator concentration)/(the monomer concentration) (=a/b) each of the invention, indicated the stable particle-size and particle-size distribution and produced a very small amount of cohered matters and, further, they were also stable in the molecular weight and molecular weight distribution of the produced polymers. On the other hand, P-17 through P-20, which were out of the scope of the initiator amount, surfactant amount and the ratio of (the initiator concentration)/(the monomer concentration) (=a/b) each of the invention, were problematic, respectively. P-18 having a ratio of a/b lower than that within the scope of the invention could not complete any polymerization. P-19 having a lower surfactant concentration could not be practically used, because the cohered matters were seriously produced. On the contrary, P-20 having a higher surfactant concentration had a phase separation between the pigment and the particle. Further, P-17 having a higher polymerization initiator concentration also had a phase separation between the pigment and the polymer particle.

(Example 3)

As the non-spherical particle, the magenta pigment-including polymer particle of P-9 was adjusted to have a pH of 6.5. Then, 150 ml of the pH-adjusted pigment-including polymer particle dispersion liquid P-9 was put into a 500-ml capacity four-head separable flask attached with a stirrer, a cooling pipe and a temperature sensor. The resulting mixture was stirred at 250 rpm at room temperature. After that, 35 ml of isopropanol was added thereto. The temperature of the resulting mixed solution was raised to 85° C. After the solution was reacted for 6 hours, it was cooled down to room temperature. The resulting reacted solution was measured to find the particle-size and particle-size distribution by making use of a laser diffraction type particle-size distribution measuring instrument SALD-110 (manufactured by Shimazu Mfg. Works, Ltd.). Further, the non-spherical particle was filtrated and was then suspension-dispersed in distilled water. After the pH thereof was adjusted to be 13 by making use of an aqueous 1N-sodium hydroxide solution and the carboxylic acid was then set to be in the completely dissociated state, the washing treatment was repeated to remove the admixture such as an electrolyte and the drying treatment was carried out so as to take out a powder.

The BET specific surface area of the resulting powder was measured and, the non-spheral degree of the powder was calculated out from the average particle-size obtained through a laser diffraction type particle-size distribution measuring instrument SALD-1100. The resulting non-spherical particles were proved to have an average particle-size of $d_{50}$=5.21 μm, CV=0.91 and a non-sphering degree was 4.51.

Non-spherical particle of Example 1 NS-001 through 006 were referred to as the toner of the invention (1) through (6), and the above-described non-spherical particle was referred to as Comparative toner (1). Each of them was mixed, in a toner concentration of 5%, with a carrier comprising a ferrite particle having an average particle-size of 50 μm coated with a styrene/methyl methacrylate copolymer. The resulting mixture was shaked under each of the different conditions giving in Table 6 and the resulting statically charged amount was measured.

The results thereof will be shown in Table 6 given below.

TABLE 6

| | Amount charged (μC/g) | | |
|---|---|---|---|
| | 10° C./25% RH | 20° C./55% RH | 30° C./85% RH |
| Invented toner | | | |
| (1) | 28.3 | 28.5 | 28.3 |
| (2) | 27.1 | 26.7 | 27.5 |
| (3) | 26.6 | 28.3 | 27.2 |
| (4) | 24.9 | 23.1 | 22.9 |
| (5) | 29.3 | 29.6 | 29.2 |
| (6) | 23.8 | 23.4 | 22.8 |
| Comparative toner (1) | 31.4 | 24.6 | 19.3 |

As described above, the charged amount of a toner of the invention was proved to be stable without any conditional difference. On the other hand, it was found that the charged amount of a toner for comparison was not stable and serious in conditional difference.

(Example 4)

To each of the toners of the invention (1) through (6) and comparative toner (1), silica and titanium oxide were added in the proportions of 2% by weight and 1% by weight, and mixed up together, respectively. To 5 parts each by weight of the resulting toners, 95 parts by weight of resin-coated ferrite particles (having an average particle-size of 50 μm: served as the carrier) surface-coated with methyl methacrylate/styrene copolymer (MMA/St=7/3) was mixed in, so that the developers of the invention (1) through (6) and the comparative developer (1) were each prepared.

The practical copy-image forming tests were each tried by making use of the above-mentioned developers and an electrophotographic copying machine equipped with a heat-roller fixing unit and a cleaning blade, (U-Bix 3032 manufactured by Konica Corp.), and the evaluations on the following points.

(1) Resolving power

A copied image of a fine-line chart was prepared and the judgment was made by the numbers of the distinguishable fine lines per mm.

(2) Fogging

Under the ordinary temperature and humidity conditions (at 20° C. and 60% RH), copied images were formed continuously. Color-reflection density was measure on the white background portions by green light using a Sakura Densitometer PDA-60 manufactured by Konica Corp. At the point of time when the resulting reflection density exceeded 0.02, a fogging was judged in terms of the numbers of the copies.

(3) Off-set production temperature

Copied images were formed by varying stepwise the temperature of the fixing roller. At the point of time when producing a toner contamination produced by a hot offset, the temperature of the fixing roller was measured as an off-set production temperature.

(4) Coloring degree of toner

A single layer of a toner particle was pasted on a white label. Color reflection density was measured by green light using the toner layer and a Sakura Densitometer PDA-60 and, when the resulting density was not lower than 1.3, it graded G and, when it was not higher than 1.3, it graded P.

(5) Cleaning property

The surface of a subject photoreceptor was observed by the eye, and the cleaning property was evaluated by the numbers of copying time at the point of time when a cleaning failure was produced.

(6) Variations of particle-size distribution

This was evaluated by the changes of a percentage of the numbers of toners having a volumetric particle-size of not larger than ⅓ of the volumetric average particle-size. In the practical copying tests, the particle-size distributions were measured in the aging stages, namely, the volumetric particle-sizes of a toner were measured every time when starting the test, producing a fog and completing the 50,000th copy. The variation of the toner particle size and its distribution are mainly caused by crushing the particle during the running of the copying operation. The resulting percentage of the numbers of toners having a volumetric particle-size of not larger than ⅓ of the volumetric average particle-size was indicated. For the measurements, a laser diffraction type particle-size distribution measuring apparatus SALD-1100 was used.

(7) Measurement of transmittance

A toner of the invention was put on a 50 μm-thick transparent polyethylene terephthalate sheet so that the reflection density can be 1.0, and they were fixed with fusing by making use of a hot-plate, and the resulting transmittance thereof was then measured by a spectrophotometer.

The results of the above-mentioned evaluations will be shown in Table 7 given below.

TABLE 7

| Lot No. | Resolving power (line/mm) | Fog | Offset temp. (°C.) | Toner reflection density | Cleaning property | Particle-size distribution variation (in volumetric criteria) When starting | Particle-size distribution variation (in volumetric criteria) When producing a fog or making 50,000th copy | Transmittance |
|---|---|---|---|---|---|---|---|---|
| Developer of the invention (1) | 18 | Not produced till 90,000th copy | 230 | G | Not produced till 100,000th copy | 2.5% | 2.5% | 87% |
| Developer of the invention (2) | 19 | Not produced till 90,000th copy | 220 | G | Not produced till 90,000th copy | 3.1 | 3.1 | 86 |
| Developer of the invention (3) | 20 | Not produced till 100,000th copy | 230 | G | Not produced till 100,000th copy | 3.0 | 3.2 | 89 |
| Developer of the invention (4) | 19 | Not produced till 90,000th copy | 250 | G | Not produced till 80,000th copy | 4.6 | 4.7 | 90 |
| Developer of the invention (5) | 20 | Not produced till 80,000th copy | 230 | G | Not produced till 80,000th copy | 0.9 | 0.9 | 88 |
| Developer of the invention (6) | 18 | Not produced till 100,000th copy | 230 | G | Not produced till 90,000th copy | 1.2 | 1.3 | 87 |
| Developer for comparison (1) | 16 | Not produced till 50,000th copy | 220 | P | Not produced till 60,000th copy | 11.6 | 12.6 | 61 |

From the results shown above, the magenta toner of the invention was proved to be a stable developer excellent in resolving power, antifogging, reflection density and cleaning property, and, further, very few in particle-size variation in the course of making copies. In addition to the above, it is also proved that a transmittance is very high when fixing it to a transparent sheet. On the other hand, the comparative developer is proved to be inferior to the developers of the invention from every aspect and, further, substantially low in transmittance.

(Example 5)

A magenta pigment C.I. Pigment Red 122 (KET RED 309 produced by Dainippon Ink & Chemicals Inc.) was washed with heated toluene repeatedly so that rosin salt was removed therefrom. Following this, the resulting material was dried, and then, by the use of a fluorescent X-ray analysis, it was confirmed that no calcium was detected. Then, the pigment was dispersed in ethanol again and rosin was added and dissolved therein. The dispersion was divided to eleven parts and rosin was added to each part of the dispersion in the amount of 10, 8, 6, 4, 2, 1.5, 1.25, 1.0, 0.75, 0.5, 0.25 and 0 in terms of % by weight of the pigment, respectively. To these dispersions, an aqueous calcium hydroxide solution was respectively added to form rosin-calcium salt so that it treats the surface of pigments. Then, the pigment dispersions were subjected to filtration, then, washed with ethanol and dried. These pigments were crushed to be prepared respectively as pigments (1) through (11). The amounts of calcium contained therein were measured by means of a fluorescent X-ray analysis.

In addition, to an aqueous surfactant solution wherein 3.6335 g of sodium dodecyl sulfate was dissolved in 250 ml of distilled water, 26.67 g of pigments (1) through (11) were respectively added. By the use of supersonic homogenizer Model UT-150T (produced by Nippon Seiki Seisakusho), the pigments were dispersed for one hour with an output of 300 $\mu$A. Following this, by the use of a pressure type dispersing machine MINI-LAB Type 8.30H (produced by RANNIE), the pigment solution was dispersed under the pressure of 600 Bar until the average particle sizes ($d_{50}$) reaches 0.28 $\mu$m. Incidentally, for measuring the particle size of the pigment-dispersed solution, a laser diffraction particle size measuring instrument SALD-1100 (produced by Shimadzu Seisakusho Ltd.) was used.

In a separable flasks with capacity of 500 ml of equipped with a stirrer, reflux condenser, temperature sensor and a nitrogen introducing tube, 15 ml of each pigment-dispersed solution, 1.2 g of sodium dodecyl sulfate, 235 ml of degassed ion-exchange distilled water, 25.33 g of styrene, 4.75 g of n-butyl acrylate, 1.58 g of methacrylic acid and 0.2 g of tert-dodecylmercaptane were added. While the mixtures were stirred at the stirring speed of 500 rpm under nitrogen air flow, the temperature inside a flask was raised up to 70° C. While the temperature inside the flask was kept at 70° C., an aqueous polymerization starter solution wherein 0.76 g of potassium persulfate was dissolved in 50 ml of a degassed ion-exchange distilled water was added thereto. Under this condition, polymerization was conducted for 7 hours.

Following this, agglomerated matter uncontrollably produced during the polymerization process was separated and dried. Its weight was measured to calculate the production rate of the agglomerated matter.

Next, pH of 150 ml of emulsified polymer solutions respectively using each pigment-dispersed solution was regulated to 7 by the use of an aqueous 5N-sodium hydroxide solution, and then, each solution was poured into 500 ml separable flask equipped with a stirrer, reflux condenser and a temperature sensor. While stirring it at 250 rpm at room temperature, an aqueous potassium chloride solution wherein 11.86 g of potassium chloride has been dissolved in 40 ml of ion-exchange distilled water and 20 ml of isopropanol were added. The inside temperature was increased to 80° C. and the mixture was subjected to reaction for 6 hours.

Following this, by the use of a laser diffraction particle size measuring instrument SALD-1100, particle size and particle size distribution were measured.

The results are shown below.

TABLE 8

| Pigment-dispersed solution | amount of Ca [%] | Agglomerated substance production rate [%] | Particle size distribution of nonspherical grain $d_{50}$ [μm] | CV | Note |
|---|---|---|---|---|---|
| (1) | 0.66 | 73.5 | — | | Production of agglomerates |
| (2) | 0.53 | 63.8 | — | — | Production of agglomerates |
| (3) | 0.40 | 56.2 | — | — | Production of agglomerate block |
| (4) | 0.26 | 48.3 | — | — | Production of agglomerate block |
| (5) | 0.13 | 45.1 | 32.9 | 0.42 | There are much aggromerates |
| (6) | 0.10 | 4.1 | 5.6 | 0.43 | There are much agglomerates |
| (7) | 0.07 | 3.6 | 5.3 | 0.42 | No residue |
| (8) | 0.05 | 1.2 | 5.2 | 0.42 | No residue |
| (9) | 0.03 | 0.6 | 5.3 | 0.44 | No residue |
| (10) | 0.02 | 0.4 | 5.1 | 0.45 | No residue |
| (11) | 1 | 0.4 | 5.4 | 0.41 | No residue |

From the above-mentioned results, it can be understood that, when calcium derived from rosin-calcium contained in pigment exceeds 0.1%, a large amount of agglomerated matter is uncontrollably produced during polymerization process when it is subjected to emulsifying polymerization. In addition, in a non-sphericalizing treatment, control of size of coagulated particle cannot be carried out so that coarse agglomerates are produced. On the other hand, when the amount of calcium is reduced to 0.1% or less, emulsifying polymerization and aspherical reaction are stably carried out.

(Example 6)

By making use of pigment dispersion liquid M-6 prepared in Example 1, a polymerization was carried out in quite the same conditions as in the synthesis example of Example 1, except that 95.5% by weight of styrene and 0.5% of acrylic acid were used as the monomers, so that a magenta particle was prepared. The resulting magenta particle was measured through a particle-size distribution measuring instrument ELS-800 attached with an electrophoresis light-scattering photometer (manufactured by Ohtsuka Electron Co., Ltd.) so as to obtain the average particle-size ($d_{50}$) and the variation coefficient (CV). The results were $d_{50}$=0.21 μm and CV=0.56. The critical cohesion concentration of the resulting pigment-composite polymer particle obtained by making use of potassium chloride was 0.045 mols/liter. By making use of the pigment-composite polymer particle dispersion liquid was reacted for 3 hours upon replacing the amount of adding potassium chloride by an amount of 0.06 mols/liter in accordance with the procedures applied to Example 2. When measuring the average particle-size and variation coefficient thereof through a laser diffraction type particle-size distribution measuring instrument SALD-1100 (manufactured by Shimazu Mfg. Works, Ltd.), it was proved to be $d_{50}$=0.83 μm and CV=0.46. Also, the non-sphering degree thereof was 5.61. After the resulting particle was dialyzed by making use of a cellulose dialyzing back having a fraction molecular weight of 10,000 so as to remove an admixture, an ultrafiltration was carried out and the solid concentration was controlled to keep 5%. After a buffering treatment was carried out with a 03M phosphate buffering liquid containing 0.9% sodium chloride, an anti-α-fetoprotein antibody (1 gG-fraction) was added so as to carry out a physical adsorption to the surface of the particle. For the comparison, on the other hand, a polyethylene latexes having the average particle-sizes of $d_{50}$=0.3 μm and 0.85 μm and CV=0.63 and 0.51 were each similarly sensitized to the anti-α-fetoprotein (1 gG fraction) antibody. Further, the unadsorbed portion thereof was adsorbed by making use of a cattle blood serum albumin.

The resulting matter was diluted to have a solid concentration of 0.2% by making use of a 0.2M phosphate buffering solution (containing 0.9% sodium chloride) so as to serve as an immunodiagnosing chemical for α-fetoprotein (AFP) use. A refined human α-fetoprotein available from Dako Co., and an inert human serum were so used as to prepare the diluted system of AFP. Each of 25 μliters of AFP standard serum and 25 μliters of an immunodiagnosing chemical for α-fetoprotein (AFP) use was filtrated out and the resulting filtrates were mixed up on a microplate and allowed to stand for one hour at room temperature. Then, the resulting cohered image was observed. When a cohesion was confirmed, that is the positive, it is expressed by (+); when any cohesion could not be confirmed, it is expressed by (−); and when no judgment could not be made, it is expressed by (±); respectively.

TABLE 9

| AFP (ng/ml) | 1000 | 500 | 250 | 125 | 62.5 | 31.25 | 15.63 | 7.81 | 3.95 | 0.0 |
|---|---|---|---|---|---|---|---|---|---|---|
| Reagent of the invention (1) | + | + | + | + | + | + | + | + | ± | − |
| Reagent of the invention (2) | + | + | + | + | + | + | + | + | ± | − |
| Comparative reagent (1) | + | + | + | + | + | + | + | ± | − | − |
| Comparative reagent (2) | + | + | + | + | + | + | + | ± | − | − |

From the results shown in Table 8, the reagents of the invention have a sharp detection sensitivity such as 7.8 ng/ml and any prozone phenomenon cannot be observed even in the area where an antibody has a high concentration. Further, the resulting cohered image is so clear that the judgment thereof can readily be performed, and it is so fast that a cohered image judgment can be performed in the whole area within a time not longer than 30 minutes. It can, therefore, be said that a reagent of the invention is excellent.

On the other hand, the detection sensitivity of the comparative reagent is so low that is 15.6 ng/ml. With comparative reagent (2), a prozone phenomenon is produced when AFP is at 1000 ng/ml. That is problematic when it is used as a diagnosing reagent. Further, with some of the comparative reagents, it takes about one hour for completing a cohered image judgment and longer than one hour for the same judgment in an area having a low-concentration. That is, the reaction speed thereof is considerably slow.

What is claimed is:

1. A method for producing a non-spherical toner particle for developing an electrophotographic image comprising the steps of:

(a) dispersing pigment particles, which contain no rosin salt, or from which a rosin salt has been substantially removed, in water in the presence of a surfactant in a concentration not lower than the critical micelle concentration thereof, to form a pigment dispersion;

(b) adjusting the concentration of said pigment dispersion so that the concentration of said surface active agent in said dispersion is from 0.8 to 3 times the critical micelle concentration thereof;

(c) emulsifying a polymerizable monomer "b" in said pigment dispersion and adding a water-soluble radical polymerization initiator "a" so that the concentration of said polymerization initiator in the emulsion "a" in mol per liter and that of said monomer "b" in mol per liter satisfy the following equations $$0.001 \leqq a \leqq 0.030,$$

and $$0.004 \leqq a/b \leqq 0.100;$$

(d) polymerizing said monomer to form polymer particles each including said pigment particles;

(e) coagulating said polymer particles by adding an electrolyte and an organic solvent which is infinitely soluble in water to form coagulated particles; and (f) fusing said polymer particles in the coagulated particles by heating at a temperature from 5° C. below the glass transition temperature of said polymer to a temperature of 50° C. above the glass transition temperature of said polymer to form non-spherical toner particles.

2. The method of claim 1, wherein said pigment is a quinacridone.

3. The method of claim 1, wherein said polymerizable monomer consists essentially of a hydrophobic monomer in an amount of 85% to 99.9% by weight and a hydrophilic monomer having an ion dissociative group in an amount of 0.1% to 15% by weight wherein the weight percents are based upon the total weight of the hydrophobic monomer and the hydrophilic monomer.

4. The method of claim 3, wherein said ionic dissociative group is a carboxyl group, a sulfonic acid group, a phosphoric acid group, a primary amino group, a secondary amino group, a tertiary amino group or a quaternary ammonium salt group.

5. The method of claim 3, wherein at least some ionic dissociative groups of the polymer formed by polymerization of the hydrophobic monomer and the hydrophilic monomer are in a dissociated state at coagulation.

* * * * *